US006645047B1

(12) United States Patent
Liskow

(10) Patent No.: US 6,645,047 B1
(45) Date of Patent: Nov. 11, 2003

(54) AUTOMATIC GAGE HEAD POSITIONING SYSTEM

(75) Inventor: Karl J. Liskow, Ypsilanti, MI (US)

(73) Assignee: Control Gaging, Inc., Ann Arbor, MI (US)

( * ) Notice: Subject to any disclaimer, the term of this patent is extended or adjusted under 35 U.S.C. 154(b) by 0 days.

(21) Appl. No.: 09/528,385

(22) Filed: Mar. 20, 2000

(51) Int. Cl.[7] ..... B24B 49/00
(52) U.S. Cl. ..... 451/9; 451/11
(58) Field of Search ..... 451/5, 8, 9, 10, 451/11, 46, 58; 33/555.1, 650, 655

(56) References Cited

U.S. PATENT DOCUMENTS

| | | | | |
|---|---|---|---|---|
| 4,637,144 A | * | 1/1987 | Schemel | 33/550 |
| 4,761,887 A | | 8/1988 | Brown et al. | |
| 5,099,585 A | | 3/1992 | Liskow | |
| 5,643,049 A | | 7/1997 | Liskow | |
| 5,689,447 A | | 11/1997 | Ward | |
| 5,761,821 A | * | 6/1998 | Laycock | 33/555.1 |
| 5,919,081 A | | 7/1999 | Hykes et al. | |
| 6,067,721 A | * | 5/2000 | Dall'Aglio et al. | 33/555.1 |
| 6,088,924 A | | 7/2000 | Esteve | |

FOREIGN PATENT DOCUMENTS

| | | |
|---|---|---|
| WO | WO 97/12724 | 4/1997 |

* cited by examiner

*Primary Examiner*—Timothy V. Eley
*Assistant Examiner*—Dung Van Nguyen
(74) *Attorney, Agent, or Firm*—Brinks Hofer Gilson & Lione

(57) ABSTRACT

An automatic gage head positioning system especially adapted for CNC grinding of reciprocating engine crankshaft journals. The system incorporates an actuated four-bar linkage mechanism for accurately controlling the path of a gage device between disengaged and gaging positions. A lost motion rotational coupling is provided to enable the gage to follow the position of the crankshaft journal during machining. A counterspring assembly positioned in the gage system base partially opposes gravity to provide precise control of the actuation force between the gage and the workpiece journal.

18 Claims, 10 Drawing Sheets

AUTOMATIC GAGE HEAD POSITIONING SYSTEM

FIELD OF THE INVENTION

This invention relates to a dimensional gage positioning system and, particularly, to one especially adapted for applying a gage device to a reciprocating engine crankshaft journal during a grinding process.

BACKGROUND OF THE INVENTION

Recent advancements in the grinding of pin journals on internal combustion engine crankshafts have resulted in a shift away from traditional crank pin grinding.

Crankshafts have main bearing journals which define the axis of rotation of the crankshaft as it rotates in the engine, and further have a number of radially offset pin journals. Traditional grinding methods require that the crankshaft be positioned about the centerline of each individual pin journal during the grinding process. Refixturing of the crankshaft for phase angle, axial position, and radial offset is required for every pin journal. Now, with the capabilities of Computer Numerical Control (CNC) machine tools, the grinding process consists of fixturing the crankshaft only once on its main bearing centerline and rotating it just as it would rotate in the engine. All of the fixturing issues of the traditional method have been replaced by CNC programmable variables. The wheelslide of the grinder which mounts the grinding wheel moves dynamically to "chase" the pin journal currently being ground, while at the same time gradually advancing until an in-process diameter gage tells the machine that it has reached the desired final diameter.

To control this process, a gage must be capable of "chasing" the pin being ground while it rotates in a circular orbit. Since the gage itself is quite lightweight, it may be driven through its required motions by the crankpin journal itself if a suitable positioning system is provided. This positioning system must also function as an actuator, to advance the gage onto the pin journal and to retract the gage far enough to allow for part repositioning, and part unloading and loading. This mechanism would preferably provide positive control over the gage to prevent applying it mispositioned, which could result in "crashing" with the CNC grinder or the workpiece and, therefore, damaging the gage.

The gage head typically used in crankshaft grinding processes consists of a gage frame designed to be mounted to a specialized gage support and an actuator. One end of the frame supports a "vee" block whose function is to support replaceable wear pads within an included angle that, in turn, bear against the workpiece. The design of the gage and frame is such that the "vee" contacts remain in contact with the workpiece at all times throughout the orbiting motion. As the grinding process decreases the size of the workpiece, the gaging "vee" advances. This motion is directly and precisely monitored by means of an active probe contact located between the two wear pads of the "vee". This active contact is connected to a plunger that transfers the relative motions of the active contact with respect to the gage frame to a standard electronic pencil probe installed at the other end of the gage frame. This probe converts position information into an electrical signal that directly relates to the diameter change of the workpiece.

As stated above, the positioning system for the orbital gage preferably serves a dual function. First, it must advance and retract the gage to and from the workpiece. Second, the positioning system must act as a support for the gage during the orbiting motion of the workpiece. This support must have compliance in the plane of motion defined by the orbiting action of the workpiece, while at the same time, exhibit quite rigid support for the gage in all other degrees of freedom. Gage accuracy is directly dependent on these features of the positioning system.

SUMMARY OF THE INVENTION

The gage head positioning system of this invention is mounted on top of the grinder wheelslide assembly. This location is provided by the grinder manufacturer, as it simplifies the problem of removing the gage from the workpiece load/unload path. In addition, it greatly simplifies the motion that the positioning system must have during the actual grinding process. The motion of the workpiece, in the reference frame of the wheelslide, is an arc along the front surface of the grinding wheel. The gage moves vertically with a magnitude equal to the chord of this arc and horizontally with a magnitude equal to the rise of this arc.

The main functional component of the positioning system of this invention is the pivot arm assembly, having a lightweight pivot arm journaling pivot shafts at each end, with one point shaft mounted to the actuator base frame. The pivot arm assembly further includes a tierod also journaled to the actuator base. A link is affixed to the tierod and pivot arm by pivot shafts. The gage mounts to a gage mount arm coupled to the link with the gage frame "vee" facing downward to straddle the workpiece. The gage is held in contact with the workpiece by gravity, and constrained to stay on the pin by the self-centering effect of the "vee".

The pivot arm, along with a tierod, the actuator base, and the link, form a four-bar linkage. This linkage assures that the gage remains in the correct orientation to "find" the workpiece as it advances. Equally important, the gage is positively located when it is disengaged from the workpiece and cannot swing into contact with the grindwheel during the loading and unloading process. The geometric relationship of the four linkage elements allows the gage to be accurately located in the retracted position as well, close to, but not touching the actual elements of the wheelslide assembly.

The gage frame "vee" sits on the workpiece angled away from the grind wheel in order to provide necessary wheel clearance. Because of this non-symmetrical orientation relative to the downward force of gravity, a prevailing torque is applied to the gage by the positioning system to optimize performance. This torque is provided by a spring-loaded pivot joint between the gage mount arm and the pivot arm link. Hard stops are also part of this pivot joint, to prevent the gage from exhibiting any more horizontal freedom of movement than that necessary to follow the workpiece orbit.

Design features are provided to keep the gagehead and moving portions of the positioning system light in weight to minimize the adverse effects of inertial loads between the gage and the workpiece. However, the contact force between the gage and the workpiece will vary greatly due to the vertical cycling of the mechanism. A counterspring assembly is provided within the actuator to reduce the magnitude of this cyclical loading. This assembly contains adjustments for spring position and spring rate. These adjustments allow the counterspring to provide appropriate characteristics for all workpiece sizes within the grinder's capabilities.

Retraction of the gage is by means of a bellcrank mounted to the hub portion of the actuator pivot arm, and a hydraulic cylinder fixed to the actuator base. When the cylinder rod is extended, it meets the bellcrank, lifting the gage into the retracted position. When the cylinder rod is retracted, the gage is allowed to drop down onto the part. The cylinder rod continues to retract away from the bellcrank, becoming completely decoupled during gaging.

Additional benefits and advantages of the present invention will become apparent to those skilled in the art to which this invention relates from the subsequent description of the preferred embodiment and the appended claims, taken in conjunction with the accompanying drawings.

DETAILED DESCRIPTION OF THE INVENTION

Figure 1:
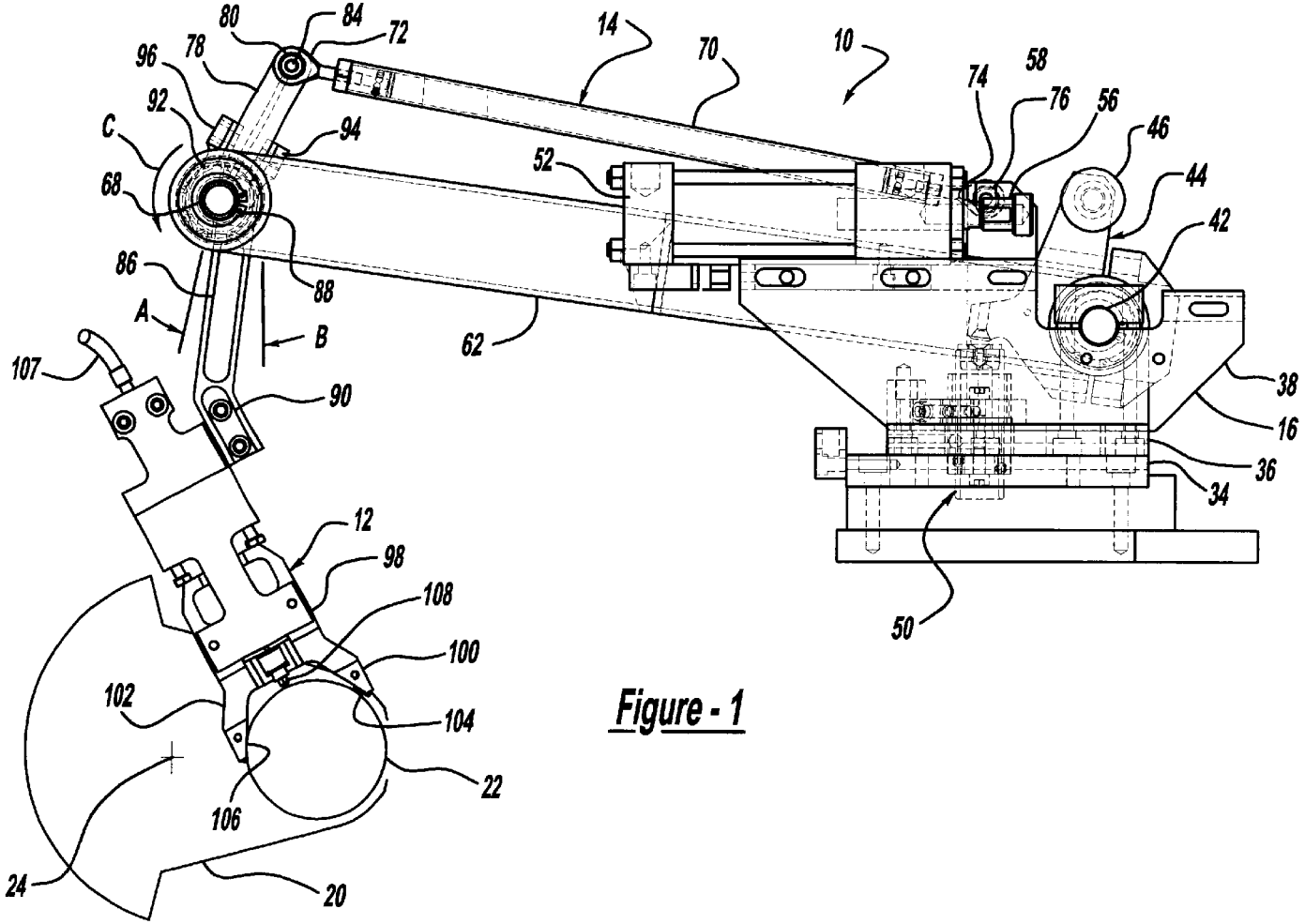
FIG. 1 is a side elevational view of the automatic gage head positioning system of the present invention shown mounting an orbital pin gage assembly and engaging a crankshaft pin journal.

The automatic gage head positioning system of the present invention is shown fully assembled in FIG. 1 and in FIGS. 5 through 11.

Automatic gage head positioning system 10 is primarily adapted for use with CNC grinding machine 18, for grinding cylindrical journal surfaces of a workpiece, such as a reciprocating engine crankshaft 20. As first shown in FIG. 5, crankshaft 20 includes pin journal 22, which is finished using grinding machine 18. Pin journal 22 orbits about the axis of rotation 24 of crankshaft 20. Grinding machine 18 further includes wheelslide 26, which strokes linearly in the right- and left-hand directions to control the horizontal position of grinding wheel 28.

Figure 5:
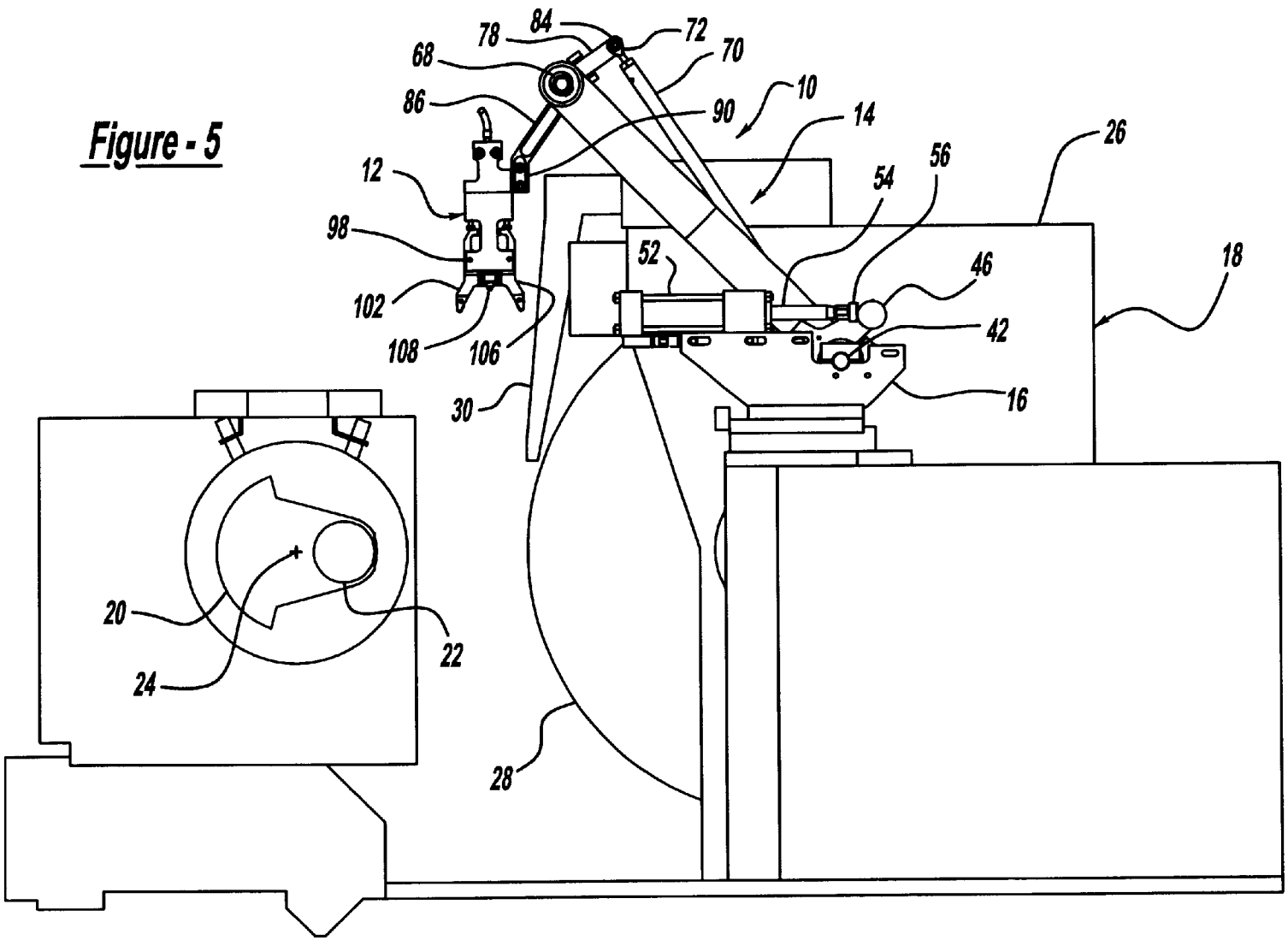
FIG. 5 is a side elevational view of the system of this invention shown installed onto a grinding apparatus and showing the pivot arm assembly retracted, with the grinder wheelslide also retracted.
Figure 6:
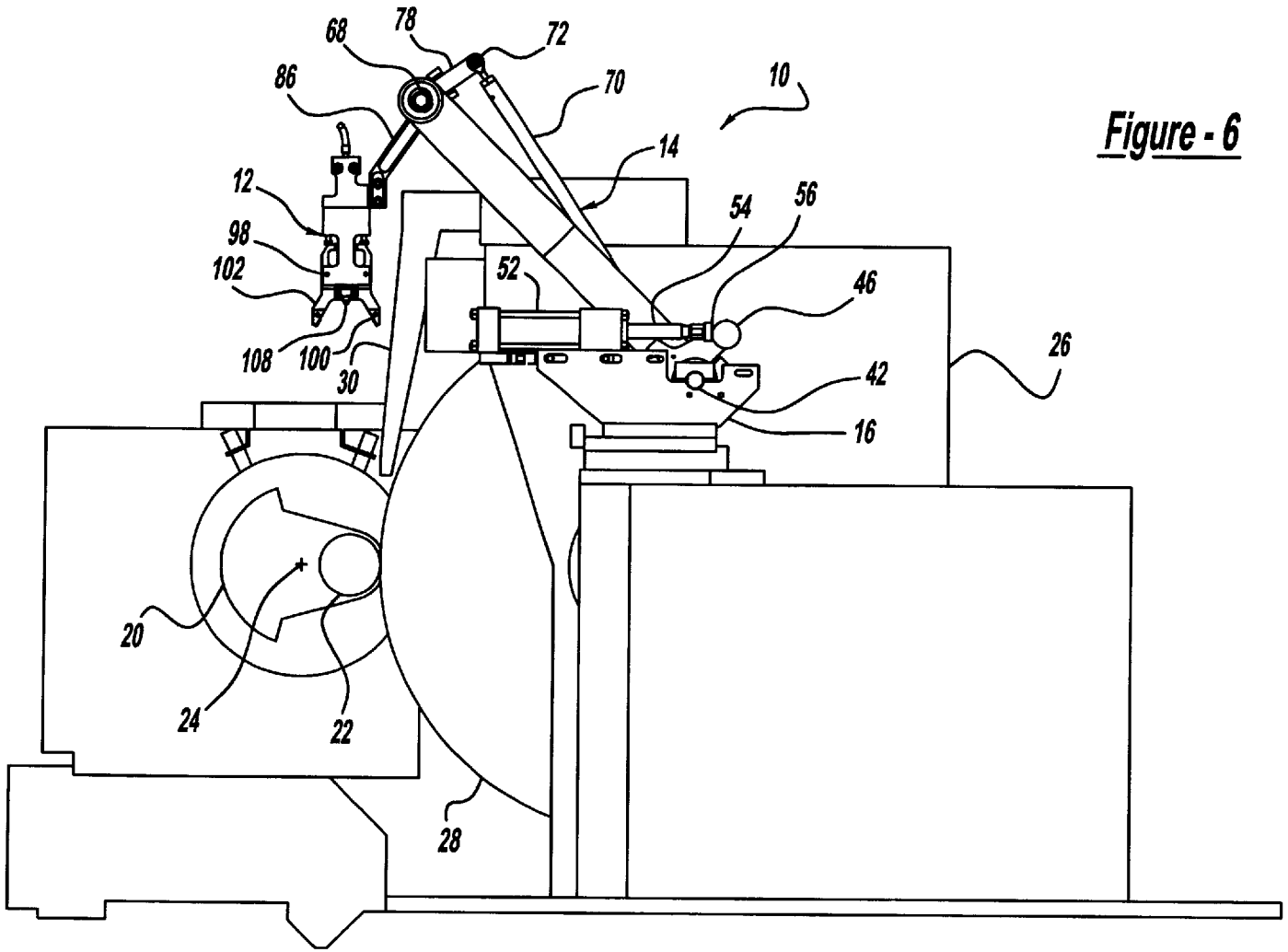
FIG. 6 is a side elevational view similar to FIG. 5, but showing the grinder wheelslide advanced to engage the workpiece.
Figure 7:
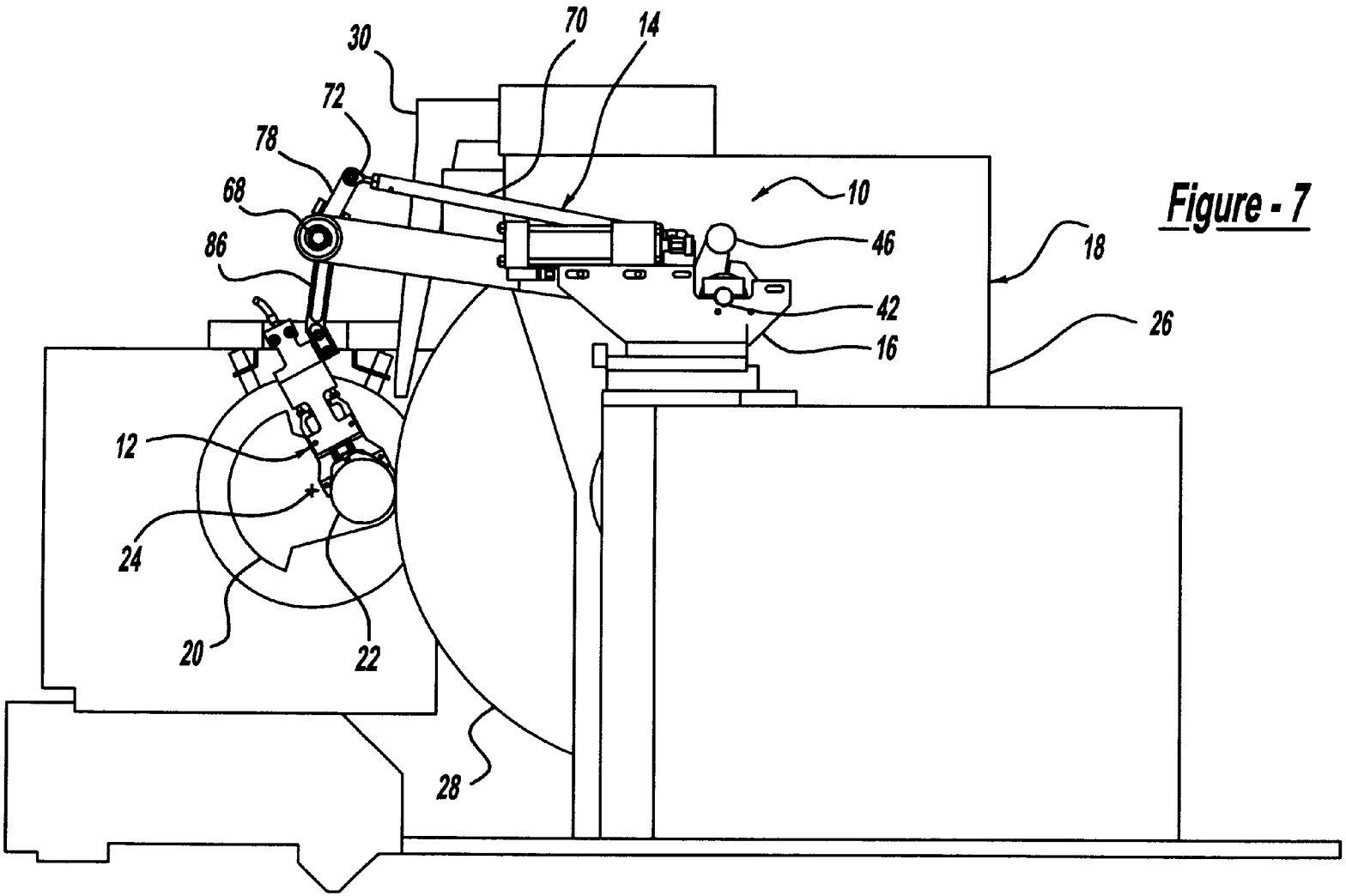
FIG. 7 is a side view similar to FIG. 5, showing the gage and wheelslide extended to engage with the workpiece journal which is shown at a three o'clock relative position.
Figure 8:
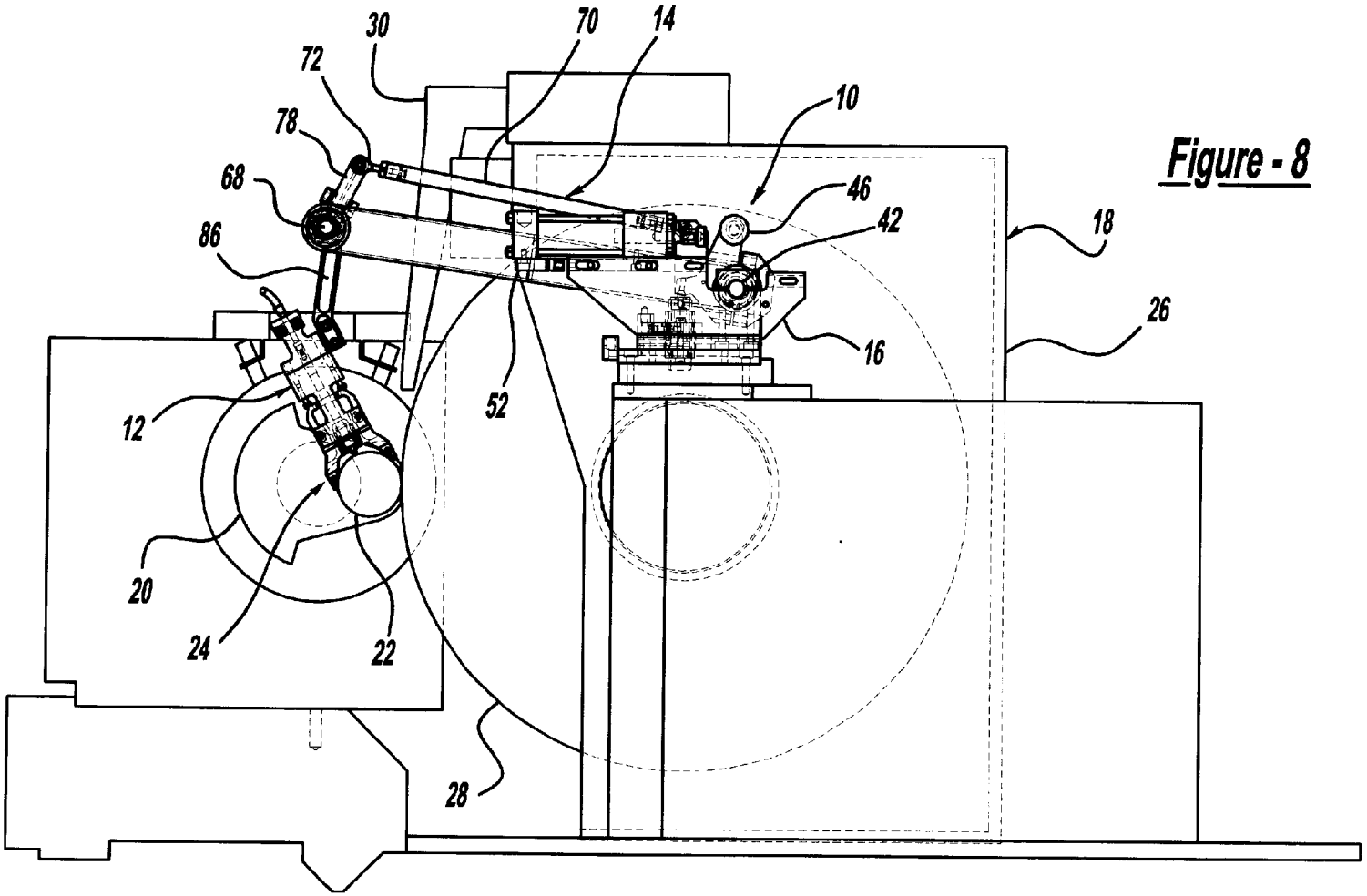
FIG. 8 is a view similar to FIG. 7, but showing the view in elevation and showing phantom lines showing details of the components.
Figure 9:
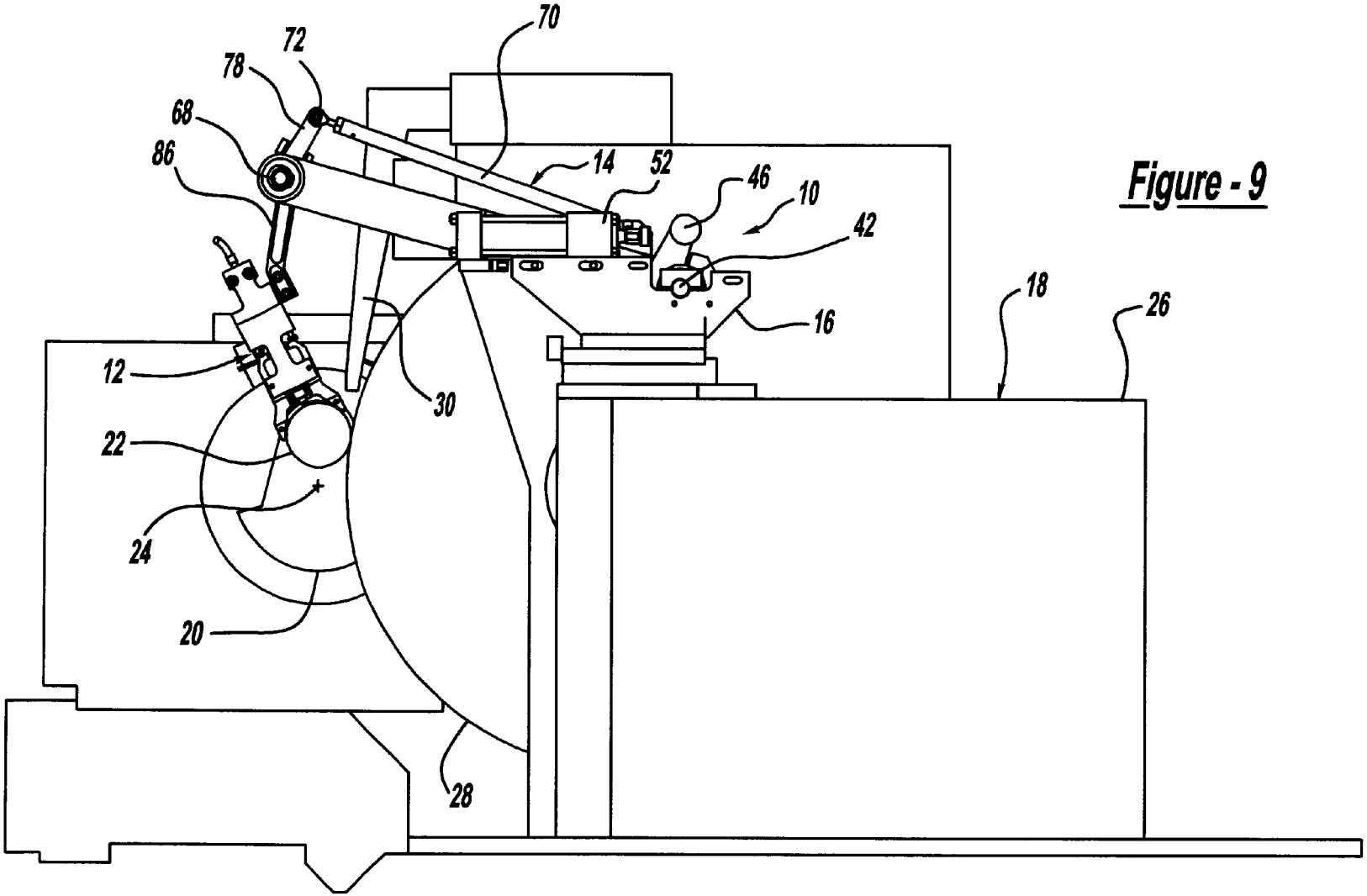
FIG. 9 is a view similar to FIG. 5, showing the workpiece journal in the twelve o'clock relative position.
Figure 10:
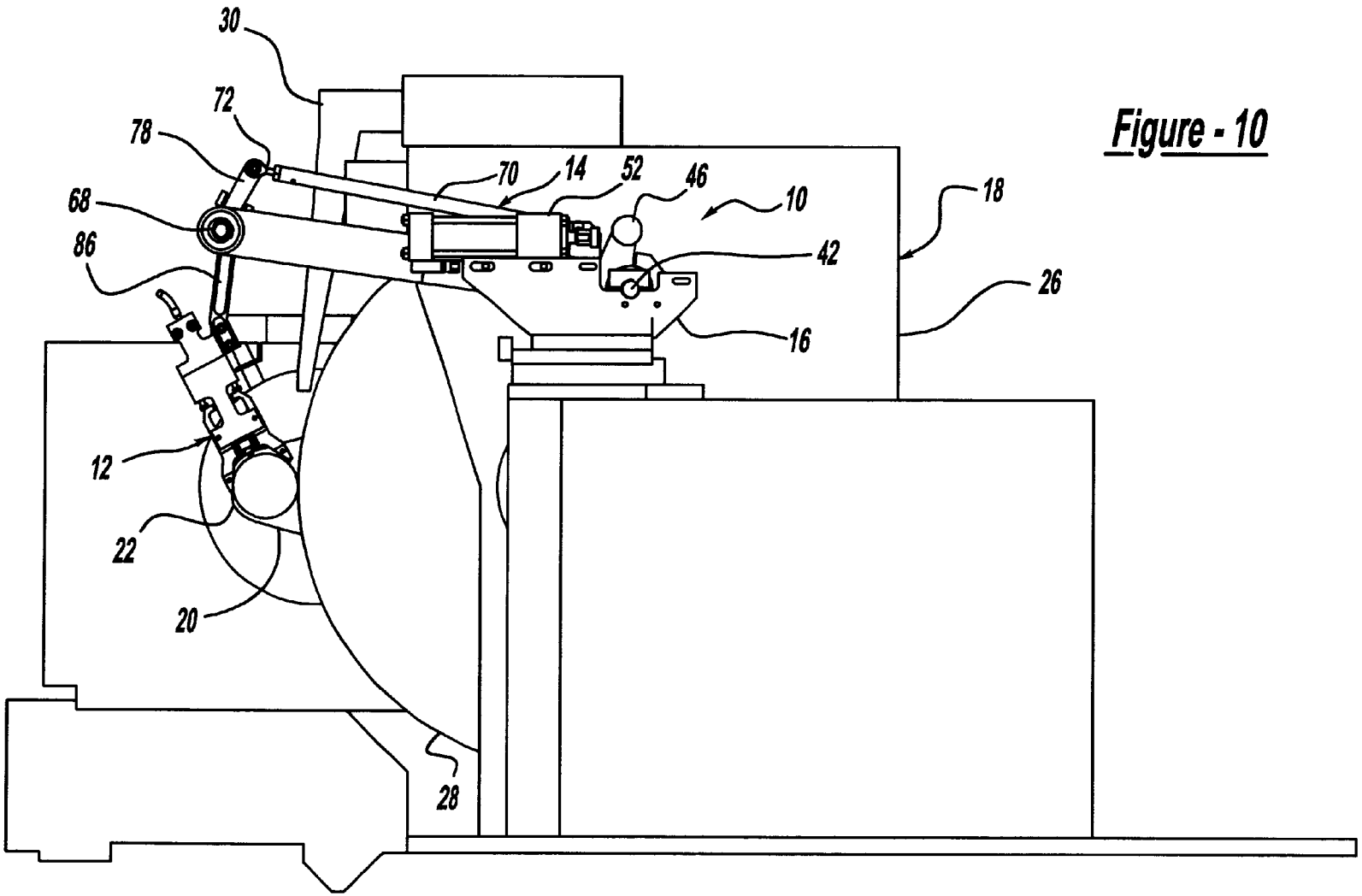
FIG. 10 is a view similar to FIG. 5, showing the workpiece journal in the nine o'clock relative position.
Figure 11:
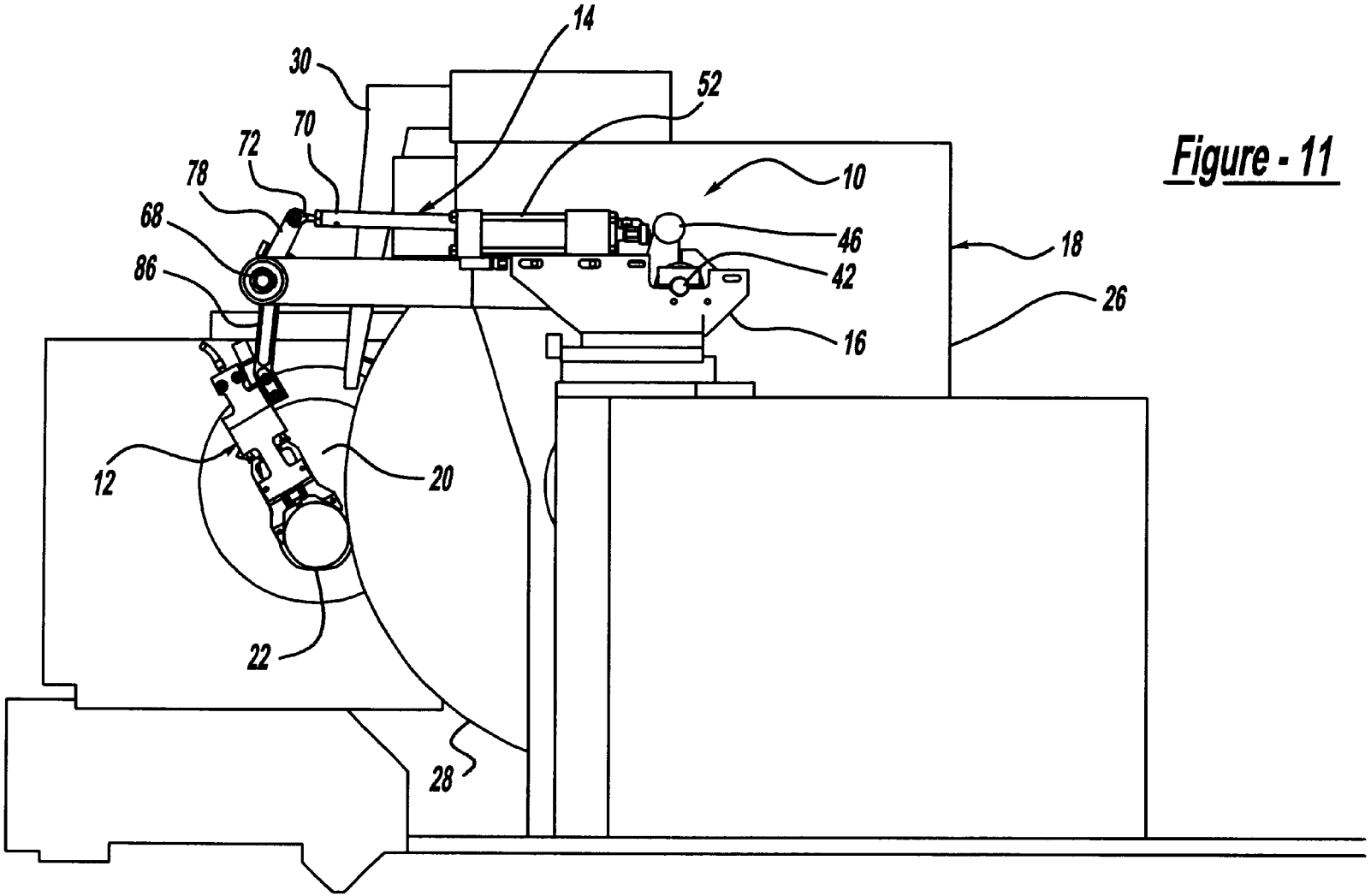
FIG. 11 is a view similar to FIG. 5, showing the workpiece journal in the six o'clock relative position.

FIG. 5 illustrates grinding machine wheelslide 26 in its right-hand-most position in which grinding wheel 28 is disengaged from crankshaft 20. FIG. 6 shows wheelslide 26 stroked in the left-hand direction, bringing grinding wheel 28 into engagement with pin journal 22 in order to perform a grinding operation. During machining, crankshaft 20 is rotated about its axis of rotation 24. Through CNC control, the horizontal position of wheelslide 26 is accurately controlled based on the rotational indexed position of crankshaft 20 to cause grinding wheel 28 to stroke such that it maintains the desired position relative to pin journal 22, thus developing the desired circular cross-sectional shape. This machining action is depicted by the figures in which FIG. 7 shows pin journal 22 at the three o'clock indexed position. Further rotation of crankshaft 20 causes pin journal 22 to reach the position shown in FIG. 9 showing the twelve o'clock position, and FIG. 10 showing the nine o'clock position, and finally, FIG. 11 showing the six o'clock position. Machining fluid floods crankshaft 20 during machining and is directed by machining fluid nozzle 30.

Actuator base 16 of automatic gage head positioning system 10 is mounted to wheelslide 26 and, therefore, follows its horizontal linear stroking motion. The components which comprise actuator base 16 are best described with reference to FIG. 2. Base 34 is mounted to wheelslide 26. Adjustment plate 36 is provided to enable fine adjustments to be made in the position of actuator base 16 relative to wheelslide 26. Such accurate positioning is required since the position of actuator base 16 defines the horizontal position of gage 12, which must be set for the gage to properly engage crankshaft pin journal 22.

Actuator base frame 38 is a generally U-shaped frame, including side plates 40 and 41 which are mounted to adjustment plate 36. Actuator base frame 38 supports pivot shaft 42 which serves as a pivot axis for pivot arm assembly 14. Bellcrank assembly 44 is mounted for rotation about pivot shaft 42 and includes a pair of projecting arms, the first mounting roller 46 and another mounting ball rest 48. Ball rest 48 engages counterspring assembly 50 which interacts with ball rest 48 to exert a clockwise torsional loading on bellcrank assembly 44, providing a function which will be described in more detail in the following sections. Internally, counterspring assembly 50 features a coil spring which preferably has means for adjustment of both its pre-load and spring rate. Other counterspring elements could also be used, including gas spring, torsion spring, or other compliant elements.

Figure 2:
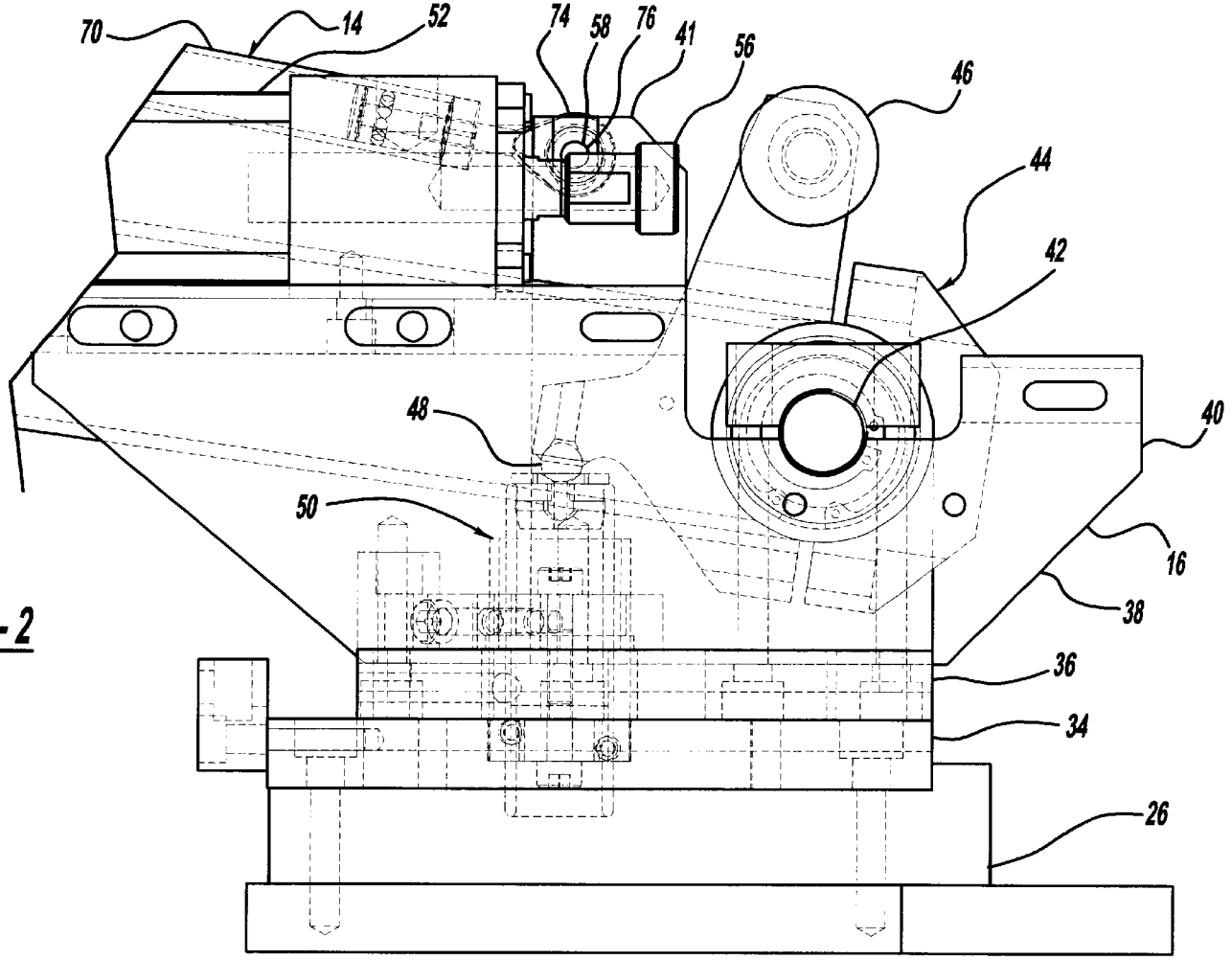
FIG. 2 is an enlarged partial side elevational view of the actuator base assembly of the system shown in FIG. 1.

Hydraulic cylinder 52 is affixed to actuator base frame 38 and includes a projecting cylinder rod 54 with cylinder rod tip 56. Cylinder 52 is actuated to move pivot arm assembly 14 between the gaging and disengaged position of the device. FIGS. 1 and 2 illustrate the system in the gaging position in which gage 12 engages pin journal 22. In this position, cylinder rod tip 56 is withdrawn and disengaged from bellcrank roller 46. When it is desired to move pivot arm assembly 14 to the disengaged position, as shown in FIG. 5, fluid pressure is applied to cylinder 52 urging cylinder rod 54 and cylinder rod tip 56 to an extended position. As shown in FIG. 5, in that condition, cylinder rod tip 56 engages roller 46. Since bellcrank assembly 44 is connected with pivot arm assembly 14, this action causes the pivot arm assembly to rotate in the clockwise direction, moving the gage to the disengaged position. In a preferred embodiment, actuator base frame 38 would further include one or more proximity sensors (not shown) in accordance with well-known machine-design principles which will enable the position of cylinder rod 54 to be monitored electronically, thus providing an electronic indication of the position of pivot arm assembly 14. Side plate 41 further includes pivot shaft 58 which interacts with pivot arm assembly 14 in a manner which will be subsequently described.

Figure 3:
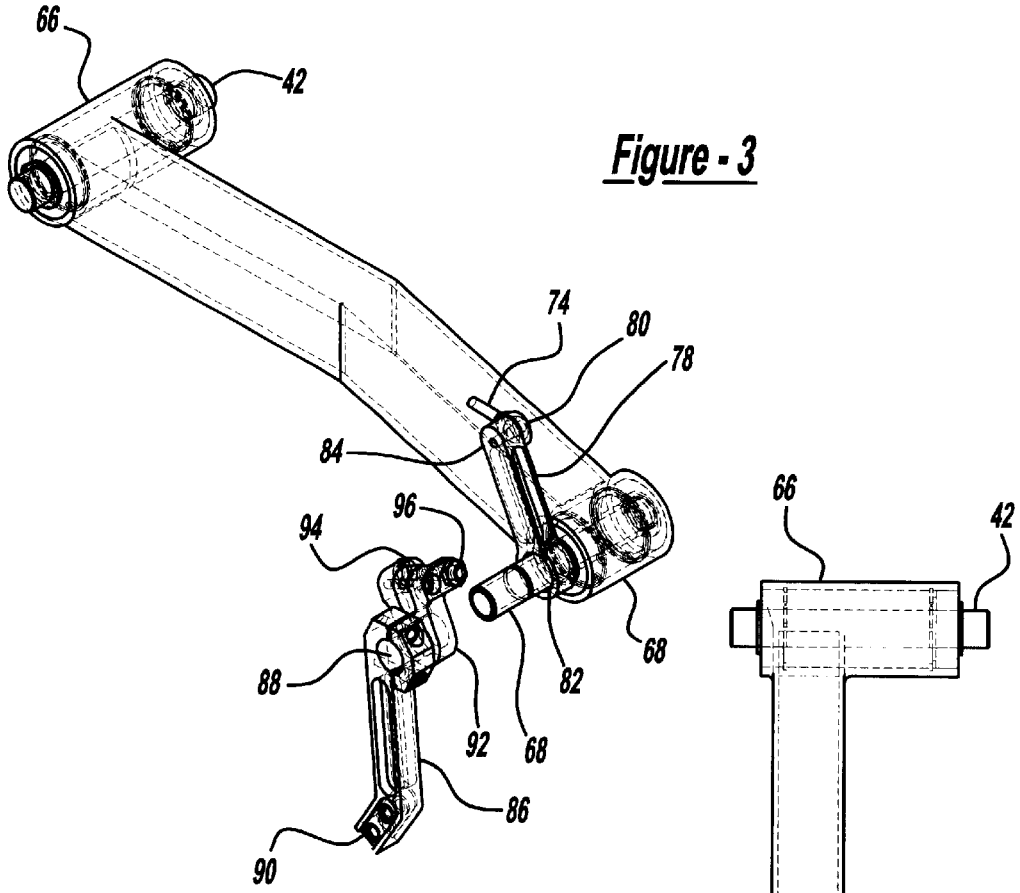
FIG. 3 is an exploded pictorial view of portions of the pivot arm assembly of the system shown in FIGS. 1 and 2.
Figure 4:
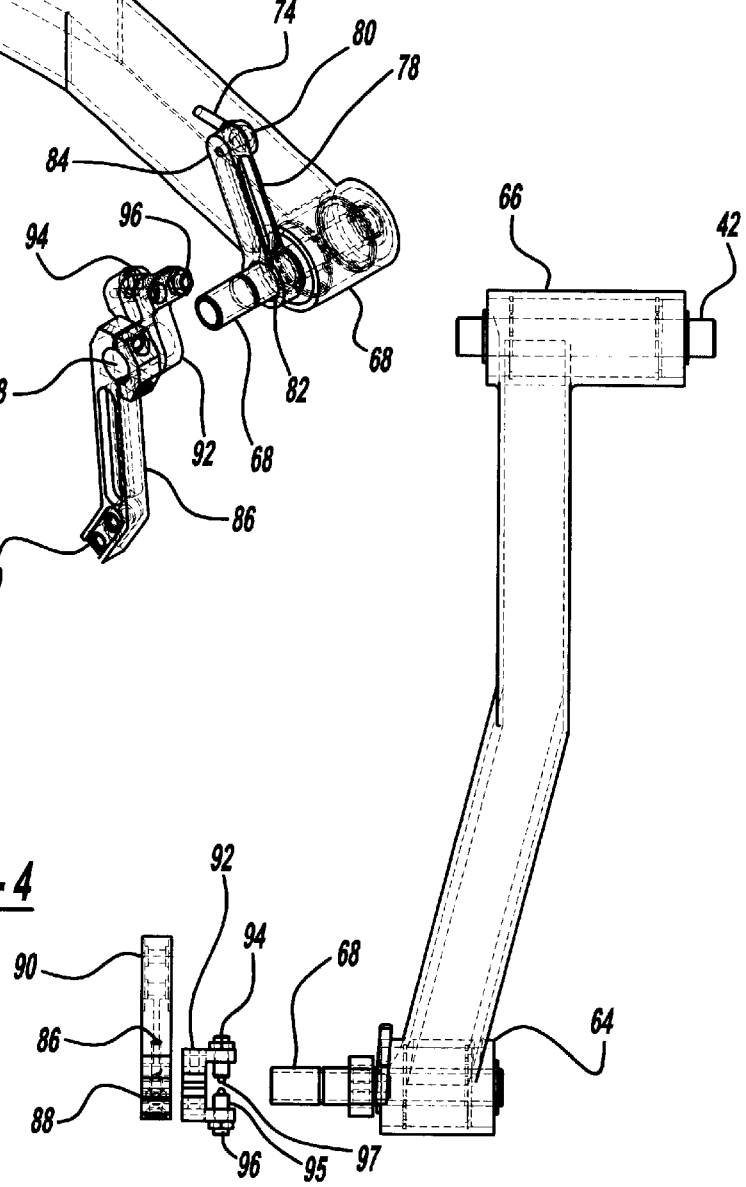
FIG. 4 is a top partially exploded view of portions of the pivot arm assembly shown in FIG. 3.

Pivot arm assembly 14 will be described with particular reference to FIGS. 1, 3, and 4. Pivot arm 62 is an elongated, hollow weldment preferably made of a lightweight material, such as aluminum, and including tubes 64 and 66 at opposite ends. Tube 66 mounts preloaded ball bearings which are journaled onto pivot shaft 42. Tube 64, in turn, includes internal preloaded ball bearings which mount pivot shaft 68. When mounted to actuator base frame 38, pivot arm 62 is capable of rotation within a limited, angular range between the positions shown in the figures. Tierod 70 includes a pair of rod ends, 72 and 74. Rod end 74 is mounted for rotational movement to actuator base frame sideplate 41 about pivot pin 76. Tierod 70 is preferably formed from hollow, tubular stock, also made of a lightweight material, such as aluminum. Preferably, rod ends 72 and 74 can be adjusted to change the center-to-center distance between the rod ends, providing an adjustment capability for pivot arm assembly 14. Pivot arm link 78 includes a pair of journals, 80 and 82. Journal 80 supports pivot pin 84 which acts as a point of rotation for rod end 72. Journal 82 provides for rotational motion about pivot shaft 68.

As is evident from the figures, and particularly FIG. 1, the axes of rotation of pivot arm 62 and tie rod tube 70 on actuator base 16 are displaced. Accordingly, pivot arm 62, link 78, tie rod 70, and a portion of actuator base frame 38 combine with pivot shafts 42, 68, and pivot pins 76 and 84 to define an articulating four-bar linkage. The articulation of these elements is illustrated by the various figures. FIG. 1 illustrates gage system 10 in the gaging position, whereas FIG. 5 illustrates the unit in its disengaged position. Movement between these positions is driven by bellcrank assembly 44 which is coupled to pivot arm 62.

Gage 12 is mounted to gage mount arm 86 which includes journal 88 at one end and gage mounting fastener bores 90. As best shown in FIGS. 3 and 4, yoke 92 mounts to gage mount arm 86 and is also journaled for rotation about pivot pin 68. Yoke 92 is constrained to rotate with gage mount arm 86 about pivot shaft 68. Yoke 92 further includes a pair of projecting arms which mount stop pins 94 and 96. Stop pins 94 and 96 engage link 78 and provide a limited degree of lost motion between gage mount arm 86 and link 78. By adjusting the axial positions of stop pins 94 and 96, the number of degrees of relative angular motion permitted between link 78 and arm 86 can be adjusted. Stop pins 94 and 96 are positioned to engage opposite surfaces of link 78. In a preferred embodiment, one or both of stop pins 94 and 96 would include an internal compliant element, for example, a coil spring which provides a compliant force. FIG. 4 shows stop pin 96 having an internal coil spring 95 which is compressed by tip 97. This compliant force would exert a rotational torque upon gage mount arm 86 in conditions in which link 78 engages with the compliant stop pin 94 or 96. With reference to FIG. 1, lines A and B designate a range of angular lost motion for arm 86 relating to link 78 (exaggerated for illustration). Also shown in that figure is a torque C acting on arm 86 developed through compression of compliant stop pin 96.

Gage 12 may be of various types, generally employed for applications, such as those described herein. Gage 12 includes gage frame 98. Projecting arms 100 and 102 include wear pads 104 and 106 which engage pin journal 22 in the manner of a well-known "vee" block gaging system. Moving probe tip 108 is coupled via a shaft to an internal pencil-type gaging device which provides an electrical output on cable 107 related to the diameter of pin journal 22. Such internal gaging device may be of various types used in the gaging industry. For example, pneumatic gage devices, LVDTs, piezo electric and other gage devices could be employed.

Now with reference particularly to FIGS. 1 and 5 through 11, operation of gage system 10 will be described in greater detail. FIG. 1 illustrates the position of the components when pivot arm assembly 14 is in the gaging position. In that condition cylinder rod tip is disengaged from bellcrank roller 46. Gravity acting upon pivot arm assembly 14 urges gage 12 into engagement with pin journal 22. The actuation force exerted by pivot arm assembly 14 is partially opposed by the interaction between bellcrank ball rest 48 and counterspring assembly 50. During grinding operation, the relative motion between gage system 10 and pin journal 22 is an arcuate path in the generally vertical direction resulting as the journal moves between the twelve o'clock position shown in FIG. 9, to the six o'clock position shown in FIG. 11. Due to this arcuate motion, it is necessary for pivot arm assembly 14 to provide a range of compliance or lost motion, enabling gage 12 to follow the contour and path of pin journal 22. Once gage 12 is engaged with pin journal 22, gage wear pads 104 and 106 are intended to control its position. Pivot arm assembly 14 is thus intended during operation merely to exert the desired downward actuation force. To enable the wear pads 104 and 106 to define the gage position, lost motion is provided at the interaction between gage mount arm 86 and link 78 as explained previously.

As shown in the figures, the longitudinal axis of gage 12 defined along the line of movement of probe tip 108, is inclined from the vertical direction. This positioning is desired to avoid interference between gage arm 100 and grinding wheel 28. Due to this relative orientation of gage 12, there is a greater restraint force precluding gage 12 from being displaced in the right-hand direction, as compared with displacement in the left-hand direction. In other words, the normal contact force vector acting at wear pad 104 has a small horizontal component. In order to maintain gage 12 in engagement with pin journal 22, a compliant force acting on gage mount arm 86 urging it toward the counter-clockwise direction is desired. This feature is provided through stop pin 96 which has an internal element which is compliant in compression exerting torque force C shown in FIG. 1.

FIG. 5 illustrates gage arm assembly 14 in the disengaged position in which gage 12 is fully displaced from crankshaft 20, and wheelslide 26 is in its right-hand disengaged position. It should be noted that the path of movement of gage 12 places it close to machine fluid nozzle 30, but it does not interfere with the nozzle. Moreover, the confined path of movement of gage 12 prevents interference of the gage with other structures associated with the grinding machine 18 which are not shown, such as material handling systems, including loading gantries, etc. FIG. 6 illustrates grinding machine 18 in a position with wheelslide 26 displaced to engage pin journal 22. However, pivot arm assembly 14 remains in a disengaged position. This is a typical operational process in which an initial grinding step occurs to smoothen the surface of pin journal 22 before engaging the journal with gage 12. Since crankshaft 20 may begin this grinding process as a rough casting or raw forging, pin journal 22 may have a highly irregular surface finish. This would make gaging difficult and not necessary. Instead, an initial grinding operation is carried out in which pin journal 22 is brought to an initial diameter. FIG. 7 illustrates pivot arm assembly 14 in the engaged gaging position. Since the path of movement of gage 12 is accurately defined, the gage 12 can locate itself on pin journal 22. However, the lost motion provided by the interaction between gage mount arm 86 and link 78 allows the final location to be defined strictly by gage 12. FIGS. 9 through 11 show the crankshaft 20 in various rotationally indexed positions. These figures also illustrate that when using grinding wheel 28 as a reference, gage 12 and pin journal 22 trace an arcuate path about a portion of the circumference of grinding wheel 28.

Once a desired diameter is reached, pivot arm assembly 14 is actuated to move to the disengaged position and, thereafter, wheelslide 26 is moved to a right-hand disengaged position, thus returning the system to the condition shown in FIG. 5.

Additional benefits and advantages of the present invention will become apparent to those skilled in the art to which this invention relates from the subsequent description of the preferred embodiments and the appended claims taken in conjunction with the drawings.

What is claimed is:

1. A gage head positioning assembly for a machining tool assembly for a workpiece which rotates relative to said machining tool assembly comprising:

an actuator base mounted to said machining tool assembly;

a pivot arm assembly having a pivot arm mounted for rotation to said actuator base about a first pivot axis and a tierod mounted for rotation to said actuator base about a second pivot axis displaced from said first pivot axis, said pivot arm and said tierod further being rotationally affixed to a link at third and fourth displaced pivot axes respectively, whereby said pivot arm, said tierod, said link, and said actuator base cooperate to form a four-bar linkage with relative rotational movement provided at said first, second, third, and fourth pivot axes;

a gage mount arm mounted to said pivot arm for rotation about said third pivot axis and coupled to said link;

a gage head mounted to said gage mount arm; and an actuator mounted to said actuator base and acting upon said pivot arm, causing said pivot arm to rotate between a retracted position in which said gage head is disengaged from said workpiece, and a gaging position in which said gage head is engaged with said workpiece.

2. The gage head positioning assembly invention according to claim 1 further comprising:

a lost motion coupling which couples said link with said gage mount arm whereby lost angular motion occurs between said link and said gage mount arm about said third pivot axis within a range of angular displacement.

3. The gage head positioning assembly according to claim 2 further comprising:

a spring providing torsional compliance acting between said link and said gage mount arm, thereby exerting a torque on said gage mount arm.

4. The gage head positioning assembly according to claim 1 wherein said gage comprises:

a "vee" -block and a moveable probe which engage said workpiece.

5. The gage head positioning assembly according to claim 1 further comprising:

a bellcrank assembly totally mounted to said actuator base about said first pivot axis, affixed to said pivot arm, and wherein said actuator engages said bellcrank to displace said gage head between said retracted and gaging positions.

6. The gage head positioning assembly according to claim 1 wherein said actuator comprises:

a hydraulic cylinder having a moveable cylinder rod which is coupled to said pivot arm.

7. The gage head positioning assembly according to claim 1 wherein said pivot arm assembly biases said gage head into engagement with said workpiece in said gaging position under the influence of gravity.

8. The gage head positioning assembly according to claim 7 comprising:

a counterspring mounted to said actuator base and acting upon said pivot arm assembly and partially opposing said influence of gravity biasing said gage head.

9. The gage head positioning assembly according to claim 1 wherein said machining tool comprises:

a grinder, and said workpiece comprising a crankshaft having at least one pin journal having a center displaced from an axis of rotation of said crankshaft and when said actuator base is mounted to a wheelslide assembly of said grinder which strokes horizontally machining said workpiece journal.

10. A gage head positioning assembly for a crankshaft grinder for machining pin journals of said crankshaft as crankshaft is rotated, said pin journals having centers offset from an axis of rotation of said crankshaft, said grinder having a wheelslide assembly for linearly stoking a grinding wheel under CNC control to machine a desired diameter of said pin journals as said crankshaft is rotated, said gage head positioning assembly comprises:

an actuator base mounted to said grinder wheelslide;

a pivot arm assembly having a pivot arm mounted for rotation to said actuator base about a first pivot axis and a tierod mounted for rotation to said actuator base about a second pivot axis displaced from said first pivot axis, said pivot arm and said tierod further being rotationally affixed to a link at third and fourth displaced pivot axes respectively, whereby said pivot arm, said tierod, said link, and said actuator base cooperate to form a four-bar linkage with relative rotational movement provided at said first, second, third, and fourth pivot axes;

a gage mount arm mounted to said pivot arm for rotation about said third pivot axis and coupled to said link;

a gage head mounted to said gage mount arm; and an actuator mounted to said actuator base and acting upon said pivot arm, causing said pivot arm to rotate between a retracted position in which said gage head is disengaged from said pin journals, and a gaging position in which said gage head is engaged with said pin journals.

11. The gage head positioning assembly invention according to claim 10 further comprising:

a lost motion coupling which couples said link with said gage mount arm whereby lost angular motion occurs between said link and said gage mount arm about said third pivot axis within a range of angular displacement.

12. The gage head positioning assembly according to claim 11 further comprising:

a spring providing torsional compliance acting between said link and said gage mount arm, thereby exerting a torque on said gage mount arm.

13. The gage head positioning assembly according to claim 10 wherein said gage comprises:

a "vee" -block and a moveable probe which engage said workpiece.

14. The gage head positioning assembly according to claim 10 further comprising:

a bellcrank assembly totally mounted to said actuator base about said first pivot axis, affixed to said pivot arm, and wherein said actuator engages said bellcrank to displace said gage head between said retracted and gaging positions.

15. The gage head positioning assembly according to claim 10 wherein said actuator comprises:

a hydraulic cylinder having a moveable cylinder rod which is coupled to said pivot arm.

16. The gage head positioning assembly according to claim 10 wherein said pivot arm assembly biases said gage head into engagement with said workpiece in said gaging position under the influence of gravity.

17. The gage head positioning assembly according to claim 16 comprising:

a counterspring mounted to said actuator base and acting upon said pivot arm assembly and partially opposing said influence of gravity biasing said gage head.

18. The gage head positioning assembly according to claim 10 wherein said machining tool comprises:

a grinder, and said workpiece comprising a crankshaft having at least one pin journal having a center displaced from an axis of rotation of said crankshaft and when said actuator base is mounted to a wheelslide assembly of said grinder which strokes horizontally machining of said workpiece journal.

* * * * *